US007279221B2

(12) United States Patent
Kitamura et al.

(10) Patent No.: US 7,279,221 B2
(45) Date of Patent: Oct. 9, 2007

(54) THERMAL SPRAYING POWDER

(75) Inventors: Junya Kitamura, Kakamigahara (JP); Hiroaki Mizuno, Kakamigahara (JP); Tsuyoshi Itsukaichi, Iwakura (JP)

(73) Assignee: Fujimi Incorporated, Kiyosu_Shi, Aichi (JP)

( * ) Notice: Subject to any disclaimer, the term of this patent is extended or adjusted under 35 U.S.C. 154(b) by 13 days.

(21) Appl. No.: 11/354,378

(22) Filed: Feb. 15, 2006

(65) Prior Publication Data

US 2006/0182969 A1 Aug. 17, 2006

(30) Foreign Application Priority Data

Feb. 15, 2005 (JP) ..... 2005-038288

(51) Int. Cl.
*B32B 5/66* (2006.01)

(52) U.S. Cl. ..... 428/402; 428/403; 428/404; 428/405

(58) Field of Classification Search ..... 428/402, 428/403, 404, 405
See application file for complete search history.

(56) References Cited

U.S. PATENT DOCUMENTS 6,916,534 B2 * 7/2005 Wataya et al. ..... 428/402
2001/0003271 A1 6/2001 Otsuki ..... 118/723
2002/0160189 A1 10/2002 Wayata et al. ..... 428/402
2006/0116274 A1 * 6/2006 Kitamura et al. ..... 501/152

FOREIGN PATENT DOCUMENTS

JP 2002-080954 3/2002

* cited by examiner

*Primary Examiner*—Leszek Kiliman
(74) *Attorney, Agent, or Firm*—Vidas, Arrett & Steinkraus

(57) ABSTRACT

A thermal spraying powder includes granulated and sintered particles of an yttrium-aluminum double oxide obtained by granulating and sintering a raw powder containing yttrium and aluminum. The total volume of fine pores having a diameter of 6 μm or less in one gram of the granulated and sintered particles is 0.06 to 0.25 $cm^3$. The thermal spraying powder reliably forms a thermal spray coating that is suitable for use where the thermal spray coating is subjected to a thermal shock in a corrosive atmosphere or an oxidative atmosphere and for use where the thermal spray coating is subjected to a thermal shock in a state where the thermal spray coating contacts a member that has reactivity to a base material.

11 Claims, 1 Drawing Sheet

THERMAL SPRAYING POWDER

BACKGROUND OF THE INVENTION

The present invention relates to a thermal spraying powder containing granulated and sintered particles of an yttrium-aluminum double oxide.

When using a member formed of a material that has low corrosion resistance and oxidation resistance in a corrosive atmosphere or an oxidative atmosphere, a coating formed of a material that has a superior corrosion resistance and oxidation resistance such as an yttrium-aluminum double oxide is generally provided on the surface of the member. For example, Japanese Laid-Open Patent Publication No. 2002-80954 discloses a technique for forming a thermal spray coating of an yttrium-aluminum double oxide on the surface of a base material by plasma spraying granulated and sintered particles of an yttrium-aluminum double oxide.

To suppress corrosion and oxidation of the base material by ambient gas, the thermal spray coating desirably has a high density, or a low porosity. However, if the density is too high, when the thermal spray coating is subjected to a thermal shock, for example, when a heating process with plasma or a heater and subsequent cooling process are repeated, the thermal spray coating is likely to delaminate or detach from the base material. The delamination or detachment of the thermal spray coating occurs often due to the difference between the thermal expansion coefficient of the thermal spray coating and that of the base material made of a material different from the thermal spray coating. Meanwhile, if the density of the thermal spray coating is too low, the base material in the vicinity of the boundary surface between the base material and the thermal spray coating is corroded or oxidized, because the ambient gas reaches the base material through pores in the thermal spray coating. As a result, the thermal spray coating may delaminate or detach from the base material. Furthermore, when a member that has reactivity to the base material (for example, a member made of metal or an alloy) contacts the thermal spray coating, if the density of the thermal spray coating is too low, the member that contacts the thermal spray coating reacts with the base material through pores in the thermal spray coating. As a result, the thermal spray coating may delaminate or detach from the base material.

In this respect, in the technique disclosed in the above publication No. 2002-80954, consideration for the porosity of the thermal spray coating is inadequate. Therefore, it is difficult to obtain a thermal spray coating that is suitable for use where the thermal spray coating is subjected to a thermal shock in a corrosive atmosphere or an oxidative atmosphere and for use where the thermal spray coating is subjected to a thermal shock in a state where the thermal spray coating contacts a member that has reactivity to the base material.

SUMMARY OF THE INVENTION

Accordingly, it is an objective of the present invention to provide a thermal spraying powder that reliably forms a thermal spray coating that is suitable for use where the thermal spray coating is subjected to a thermal shock in a corrosive atmosphere or an oxidative atmosphere and for use where the thermal spray coating is subjected to a thermal shock in a state where the thermal spray coating contacts a member that has reactivity to a base material.

To achieve the foregoing objectives, the present invention provides a thermal spraying powder containing granulated and sintered particles of an yttrium-aluminum double oxide obtained by granulating and sintering a raw powder containing yttrium and aluminum. The total volume of fine pores having a diameter of 6 μm or less in one gram of the granulated and sintered particles is 0.06 to 0.25 $cm^3$.

Other aspects and advantages of the invention will become apparent from the following description, taken in conjunction with the accompanying drawings, illustrating by way of example the principles of the invention.

BRIEF DESCRIPTION OF THE DRAWING

The invention, together with objects and advantages thereof, may best be understood by reference to the following description of the presently preferred embodiments together with the accompanying drawing in which.

DETAILED DESCRIPTION OF THE PREFERRED EMBODIMENTS

Figure 1:
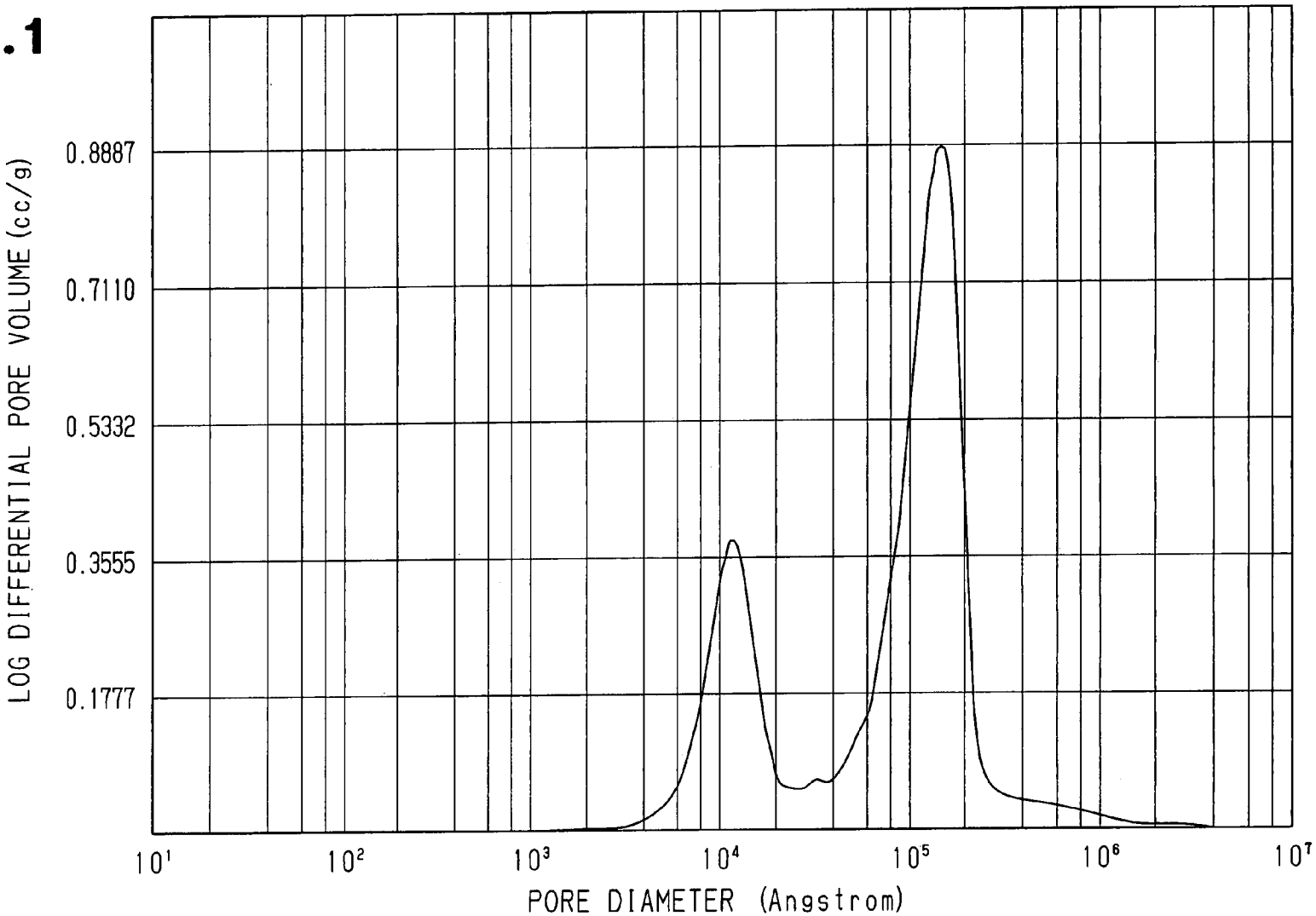
FIG. 1 is a graph of pore size distribution of a thermal spraying powder according to example 1.

One embodiment of the present invention will now be described.

A thermal spraying powder of the preferred embodiment is substantially formed of granulated and sintered particles of an yttrium-aluminum double oxide that is obtained by granulating and sintering a raw powder containing yttrium and aluminum, and is used for, for example, forming a thermal spray coating through plasma spraying.

When the total volume of fine pores having a diameter of 6 μm or less in one gram of the granulated and sintered particles is less than 0.06 $cm^3$, the thermal spray coating formed of the thermal spraying powder is likely to delaminate or detach from the base material when subjected to a thermal shock. This is because the density of the thermal spray coating formed of the thermal spraying powder becomes too high, and cracks are easily formed in the thermal spray coating by thermal expansion and thermal shrinkage. Furthermore, since the granulated and sintered particles with the total volume of fine pores having a diameter of 6 μm or less in one gram of the granulated and sintered particles being less than 0.06 $cm^3$ are dense, the granulated and sintered particles are not sufficiently softened or melted through flame spraying. Therefore, unmelted granulated and sintered particles could be mixed in the thermal spray coating and the deposit efficiency (spray yield) of the thermal spraying powder could be reduced. Therefore, to reliably obtain a thermal spray coating that is suitable for use where the thermal spray coating is exposed to a thermal shock, the total volume of fine pores having a diameter of 6 μm or less in one gram of the granulated and sintered particles must be 0.06 $cm^3$ or more. However, even if the total volume is 0.06 $cm^3/g$ or more, if it is less than 0.08 $cm^3/g$, and more specifically less than 0.09 $cm^3/g$, there is a risk that the delamination or detachment of the thermal spray coating by a thermal shock could not be significantly suppressed. Therefore, to obtain a thermal spray coating that is suitable for use where the thermal spray coating is exposed to a thermal shock, the total volume of fine pores having a diameter of 6 μm or less in one gram of the granulated and sintered particles is preferably 0.08 $cm^3$ or more, and more preferably 0.09 $cm^3$ or more.

Meanwhile, when the total volume of fine pores having a diameter of 6 μm or less in one gram of the granulated and sintered particles is greater than 0.25 $cm^3$, the thermal spray coating formed of the thermal spraying powder is likely to delaminate or detach from the base material in a corrosive atmosphere or an oxidative atmosphere. This is because since the density of the thermal spray coating formed of the thermal spraying powder becomes too low, corrosion or oxidation of the base material by the ambient gas occurs through pores in the thermal spray coating. Furthermore, when the total volume of fine pores having a diameter of 6 μm or less in one gram of the granulated and sintered particles is greater than 0.25 $cm^3$, the thermal spray coating is also likely to delaminate or detach from the base material when a member having reactivity to the base material (for example, a member made of metal or an alloy) contacts the thermal spray coating. This is because since the density of the thermal spray coating formed of the thermal spraying powder becomes too low, the member that contacts the thermal spray coating reacts with the base material through pores in the thermal spray coating. Therefore, to obtain a thermal spray coating that is suitable for use in a corrosive atmosphere or an oxidative atmosphere and for use in a state where the thermal spray coating contacts a member having reactivity to a base material, the total volume of fine pores having a diameter of 6 μm or less in one gram of the granulated and sintered particles must be 0.25 $cm^3$ or less. However, even if the total volume is 0.25 $cm^3/g$ or less, if it is greater than 0.22 $cm^3/g$, and more specifically greater than 0.20 $cm^3/g$, there is a risk that the delamination or detachment of the thermal spray coating due to corrosion or oxidation of the base material by the ambient gas and the delamination or detachment of the thermal spray coating due to reaction of the base material to the member that contacts the thermal spray coating could not be significantly suppressed. Therefore, to obtain a thermal spray coating that is suitable for use in a corrosive atmosphere or an oxidative atmosphere and for use in a state where the thermal spray coating contacts a member having reactivity to a base material, the total volume of fine pores having a diameter of 6 μm or less in one gram of the granulated and sintered particles is preferably 0.22 $cm^3$ or less, and more preferably 0.20 $cm^3$ or less.

When the peak of the pore size distribution of the granulated and sintered particles is less than 0.40 μm, more specifically less than 0.45 μm, and even more specifically less than 0.50 μm, a thermal spray coating having a slightly high density is likely to be obtained. Therefore, there is a risk that the delamination or detachment of the thermal spray coating by a thermal shock could not be significantly suppressed. This is because the density of the granulated and sintered particles is increased as the diameter of the fine pores in the granulated and sintered particles decreases. A thermal spray coating having a high density is generally obtained from a thermal spraying powder formed of granulated and sintered particles having a high density. Therefore, to obtain a thermal spray coating that is suitable for use where the thermal spray coating is exposed to a thermal shock, the peak of the pore size distribution of the granulated and sintered particles is preferably 0.40 μm or more, more preferably 0.45 μm or more, and most preferably 0.50 μm or more.

Meanwhile, when the peak of the pore size distribution of the granulated and sintered particles exceeds 4.0 μm, more specifically exceeds 3.8 μm, and even more specifically exceeds 3.7 μm, a thermal spray coating having a slightly low density is likely to be obtained. Therefore, there is a risk that the delamination or detachment of the thermal spray coating based on corrosion or oxidation of the base material by the ambient gas and the delamination or detachment of the thermal spray coating based on reaction of the base material to the member that contacts the thermal spray coating could not be significantly suppressed. This is because the density of the granulated and sintered particles is reduced as the diameter of the fine pores in the granulated and sintered particles is increased. A thermal spray coating having a low density is generally obtained from a thermal spraying powder formed of granulated and sintered particles having a low density. Therefore, to obtain a thermal spray coating that is suitable for use in a corrosive atmosphere or an oxidative atmosphere and for use in a state where the thermal spray coating contacts a member that has reactivity to a base material, the peak of the pore size distribution of the granulated and sintered particles is preferably 4.0 μm or less, more preferably 3.8 μm or less, and most preferably 3.7 μm or less.

When the average particle size of the raw powder that has not been granulated and sintered is less than 2 μm, more specifically less than 3 μm, and even more specifically less than 4 μm, a thermal spray coating having a slightly high density is likely to be obtained. Therefore, there is a risk that the delamination or detachment of the thermal spray coating by a thermal shock could not be significantly suppressed. This is because the density of the granulated and sintered particles is increased as the average particle size of the raw powder that has not been granulated and sintered is reduced. A thermal spray coating having a high density is generally obtained from a thermal spraying powder formed of granulated and sintered particles having a high density. Therefore, to obtain a thermal spray coating that is suitable for use where the thermal spray coating is exposed to a thermal shock, the average particle size of the raw powder that has not been granulated and sintered is preferably 2 μm or more, more preferably 3 μm or more, and most preferably 4 μm or more.

Meanwhile, when the average particle size of the raw powder that has not been granulated and sintered is greater than 12 μm, more specifically greater than 10 μm, and even more specifically greater than 9 μm, a thermal spray coating having a slightly low density is likely to be obtained. Therefore, there is a risk that the delamination or detachment of the thermal spray coating based on corrosion or oxidation of the base material by the ambient gas and the delamination or detachment of the thermal spray coating based on reaction of the base material to the member that contacts the thermal spray coating could not be significantly suppressed. This is because the density of the granulated and sintered particles is reduced as the average particle size of the raw powder that has not been granulated and sintered is increased. A thermal spray coating having a low density is generally obtained from a thermal spraying powder formed of granulated and sintered particles having a low density. Also, when the average particle size of the raw powder that has not been granulated and sintered is within the above mentioned range, the deposit efficiency of the thermal spraying powder could be reduced because the granulated and sintered particles are not sufficiently softened or melted by flame spraying. Therefore, to obtain a thermal spray coating that is suitable for use in a corrosive atmosphere or an oxidative atmosphere and for use in a state where the thermal spray coating contacts a member that has reactivity to a base material, and to suppress decrease of the deposit efficiency of the thermal spraying powder, the average particle size of the raw powder that has not been granulated and sintered is preferably 12 μm or less, more preferably 10 μm or less, and most preferably 9 μm or less.

When the crushing strength of the granulated and sintered particles is less than 7 MPa, more specifically less than 8 MPa, and even more specifically less than 9 MPa, the granulated and sintered particles are likely to decay. Thus, the flowability of the thermal spraying powder could be reduced due to fine particles generated by the decay of the granulated and sintered particles. As the flowability of the thermal spraying powder is reduced, supply of the thermal spraying powder from a thermal spraying powder feeder to a spray gun is likely to become unstable. As a result, the composition of the thermal spray coating formed of the thermal spraying powder is likely to become uneven or the thickness of the thermal spray coating is likely to become uneven. Furthermore, since the fine particles generated by the decay of the granulated and sintered particles are excessively melted by the flame spraying, a phenomenon called spitting, in which deposits of excessively molten thermal spraying powder fall off the inside wall of nozzle of the spray gun and are discharged towards the base material, could be caused during spraying of the thermal spraying powder. Therefore, to suppress the flowability of the thermal spraying powder from being reduced and suppress occurrence of spitting, the crushing strength of the granulated and sintered particles is preferably 7 MPa or more, more preferably 8 MPa or more, and most preferably 9 MPa or more.

Meanwhile, when the crushing strength of the granulated and sintered particles is greater than 30 MPa, more specifically greater than 27 MPa, and even more specifically greater than 25 MPa, a thermal spray coating having a slightly high density is likely to be obtained. Therefore, there is a risk that the delamination or detachment of the thermal spray coating by a thermal shock could not be significantly suppressed. This is because, granulated and sintered particles having a high crushing strength generally has a high density. A thermal spray coating having a high density is generally obtained from a thermal spraying powder formed of granulated and sintered particles having a high density. Therefore, to obtain a thermal spray coating that is suitable for use where the thermal spray coating is exposed to a thermal shock, the crushing strength of the granulated and sintered particles is preferably 30 MPa or less, more preferably 27 MPa or less, and most preferably 25 MPa or less.

When the ratio of the Fisher diameter to the average particle size of the granulated and sintered particles is greater than 0.27, more specifically greater than 0.26, and even more specifically greater than 0.25, a thermal spray coating having a slightly high density is likely to be obtained. Therefore, there is a risk that the delamination or detachment of the thermal spray coating by a thermal shock could not be significantly suppressed. This is because the density of the granulated and sintered particles is increased as the ratio of the Fisher diameter to the average particle size of the granulated and sintered particles is increased. A thermal spray coating having a high density is generally obtained from a thermal spraying powder formed of granulated and sintered particles having a high density. Therefore, to obtain a thermal spray coating that is suitable for use where the thermal spray coating is exposed to a thermal shock, the ratio of the Fisher diameter to the average particle size of the granulated and sintered particles is preferably 0.27 or less, more preferably 0.26 or less, and most preferably 0.25 or less.

Although the lower limit of the ratio of the Fisher diameter to the average particle size of the granulated and sintered particles is not particularly specified, it is preferably 0.13 or more. When the ratio of the Fisher diameter to the average particle size of the granulated and sintered particles is less than 0.13, a thermal spray coating having a slightly low density is likely to be obtained. Therefore, there is a risk that the delamination or detachment of the thermal spray coating based on corrosion or oxidation of the base material by the ambient gas and the delamination or detachment of the thermal spray coating based on reaction of the base material to the member that contacts the thermal spray coating could not be significantly suppressed. This is because the density of the granulated and sintered particles is reduced as the ratio of the Fisher diameter to the average particle size of the granulated and sintered particles is reduced, and a thermal spray coating having a low density is generally obtained from a thermal spraying powder formed of granulated and sintered particles having a low density.

When a large number of yttria is mixed in the granulated and sintered particles, the granulated and sintered particles show a property close to that of yttria. More specifically, for example, when yttria that has a higher melting point than the yttrium-aluminum double oxide is mixed in the granulated and sintered particles, the melting point of the granulated and sintered particles is increased. When the melting point of the granulated and sintered particles is increased, the granulated and sintered particles are not sufficiently softened or melted by flame spraying. Therefore, the deposit efficiency of the thermal spraying powder could be decreased. Furthermore, when a large amount of yttria is mixed in the granulated and sintered particles, a thermal spray coating having a slightly low density is likely to be obtained. Therefore, there is a risk that the delamination or detachment of the thermal spray coating based on corrosion or oxidation of the base material by the ambient gas and the delamination or detachment of the thermal spray coating based on reaction of the base material to the member that contacts the thermal spray coating could not be significantly suppressed. The amount of yttria mixed in the granulated and sintered particles (the mixed amount) is estimated based on, for example, the ratio of an X-ray diffraction peak of yttria to an X-ray diffraction peak of the yttrium-aluminum double oxide. More specifically, the mixed amount of yttria is estimated based on the ratio of the intensity of an X-ray diffraction peak of a (222) plane of yttria to the intensity of the maximum peak among an X-ray diffraction peak of a (420) plane of a garnet phase of the yttrium-aluminum double oxide, an X-ray diffraction peak of a (420) plane of a perovskite phase of the yttrium-aluminum double oxide, and an X-ray diffraction peak of a (−122) plane of a monoclinic phase of the yttrium-aluminum double oxide. To suppress adverse effects caused by mixing of yttria in granulated and sintered particles (more specifically, to suppress decrease of the deposit efficiency of the thermal spraying powder, and to obtain a thermal spray coating that is suitable for use in a corrosive atmosphere or an oxidative atmosphere and for use where the thermal spray coating contacts a member that has reactivity to a base material), the amount of yttria mixed in the granulated and sintered particles is preferably as small as possible. More specifically, the ratio of the intensity of the X-ray diffraction peak of yttria to the intensity of the maximum X-ray diffraction peak of the yttrium-aluminum double oxide is preferably 0.20 or less, more preferably 0.17 or less, and most preferably 0.15 or less. In this specification, "−1" in the (−122) plane represents a numeral 1 with an overbar.

When a large amount of alumina is mixed in the granulated and sintered particles, the granulated and sintered particles show a property close to that of alumina. More specifically, for example, there is a risk that the granulated and sintered particles could show the property of alumina that performs, at 1000 to 1100° C., a phase transition from γ-alumina having a relatively low density to α-alumina having a relatively high density, and the porosity of the thermal spray coating formed of the thermal spraying powder could be significantly increased under a high temperature. The amount of alumina mixed in the granulated and sintered particles is estimated based on, for example, the ratio of the X-ray diffraction peak of alumina to the X-ray diffraction peak of the yttrium-aluminum double oxide. More specifically, the amount of alumina mixed in the granulated and sintered particles is estimated based on the ratio of the intensity of an X-ray diffraction peak of a (104) plane of alumina to the intensity of the maximum peak among the X-ray diffraction peak of the (420) plane of the garnet phase of the yttrium-aluminum double oxide, the X-ray diffraction peak of the (420) plane of the perovskite phase of the yttrium-aluminum double oxide, and the X-ray diffraction peak of the (−122) plane of the monoclinic phase of the yttrium-aluminum double oxide. To suppress adverse effects caused by mixing of alumina in the granulated and sintered particles (more specifically, to suppress increase of the porosity of the thermal spray coating under a high temperature), the amount of alumina mixed in the granulated and sintered particles is preferably as small as possible. More specifically, the ratio of the intensity of the X-ray diffraction peak of alumina to the intensity of the maximum X-ray diffraction peak of the yttrium-aluminum double oxide is preferably 0.20 or less, more preferably 0.17 or less, and most preferably 0.15 or less.

When the average particle size of the granulated and sintered particles is less than 15 μm, more specifically less than 18 μm, and even more specifically less than 20 μm, a large amount of relatively small particles are included in the thermal spraying powder, which could reduce the flowability of the thermal spraying powder. As described above, as the flowability of the thermal spraying powder is reduced, the composition of the thermal spray coating formed of the thermal spraying powder is likely to become uneven, or the thickness of the thermal spray coating is likely to become uneven. Therefore, to suppress the flowability of the thermal spraying powder from being reduced, the average particle size of the granulated and sintered particles is preferably 15 μm or more, more preferably 18 μm or more, and most preferably 20 μm or more.

Meanwhile, when the average particle size of the granulated and sintered particles is greater than 70 μm, more specifically greater than 65 μm, and even more specifically greater than 60 μm, the granulated and sintered particles are not sufficiently softened or melted by flame spraying. Therefore, the deposit efficiency of the thermal spraying powder could be reduced. Therefore, to suppress the deposit efficiency of the thermal spraying powder from being reduced, the average particle size of the granulated and sintered particles is preferably 70 μm or less, more preferably 65 μm or less, and most preferably 60 μm or less.

When the bulk specific gravity of the granulated and sintered particles is greater than 1.6, more specifically greater than 1.4, and even more specifically greater than 1.3, a thermal spray coating having a slightly high density is likely to be obtained. Therefore, there is a risk that the delamination or detachment of the thermal spray coating by a thermal shock could not be significantly suppressed. This is because the granulated and sintered particles having a high bulk specific gravity generally has a high density, and a thermal spray coating having a high density is generally obtained from a thermal spraying powder formed of granulated and sintered particles having a high density. Therefore, to obtain a thermal spray coating that is suitable for use where the thermal spray coating is exposed to a thermal shock, the specific gravity of the granulated and sintered particles is preferably 1.6 or less, more preferably 1.4 or less, and most preferably 1.3 or less.

When the ratio of the number of moles of yttrium in the granulated and sintered particles converted into yttria to the number of moles of aluminum in the granulated and sintered particles converted into alumina is less than 0.30, more specifically less than 0.40, and even more specifically 0.45, the granulated and sintered particles could show the property close to that of alumina. More specifically, for example, there is a risk that the granulated and sintered particles could show the property of alumina that performs, at 1000 to 1100° C., a phase transition from γ-alumina to α-alumina, and the porosity of the thermal spray coating formed of the thermal spraying powder could be significantly increased under a high temperature. Therefore, to suppress the porosity of the thermal spray coating from being increased under a high temperature, the above mentioned ratio of the number of moles of yttrium to the number of moles of aluminum in the granulated and sintered particles is preferably 0.30 or more, more preferably 0.40 or more, and most preferably 0.45 or more.

When the ratio of the number of moles of yttrium in the granulated and sintered particles converted into yttria to the number of moles of aluminum in the granulated and sintered particles converted into alumina is greater than 1.5, more specifically greater than 1.3, and even more specifically greater than 1.1, the granulated and sintered particles could show the property close to that of yttria. More specifically, for example, when yttria the melting point of which is higher than that of the yttrium-aluminum double oxide is mixed in the granulated and sintered particles, the melting point of the granulated and sintered particles is increased. As a result, the deposit efficiency of the thermal spraying powder could be reduced. Therefore, to suppress decrease of the deposit efficiency of the thermal spraying powder, the above mentioned ratio of the number of moles of yttrium to that of aluminum in the granulated and sintered particles is preferably 1.5 or less, more preferably 1.3 or less, and most preferably 1.1 or less.

When the angle of repose of the granulated and sintered particles is greater than 50 degrees, more specifically greater than 47 degrees, and even more specifically greater than 45 degrees, the flowability of the thermal spraying powder could be reduced. As described above, as the flowability of the thermal spraying powder is reduced, the composition of the thermal spray coating formed of the thermal spraying powder is likely to become uneven, or the thickness of the thermal spray coating is likely to become uneven. Therefore, to suppress the flowability of the thermal spraying powder from being reduced, the angle of repose of the granulated and sintered particles is preferably 50 degrees or less, more preferably 47 degrees or less, and most preferably 45 degrees or less.

When the aspect ratio of the granulated and sintered particles is greater than 2.0, more specifically greater than 1.8, and even more specifically greater than 1.5, the flowability of the thermal spraying powder could be reduced. As described above, as the flowability of the thermal spraying powder is reduced, the composition of the thermal spray coating formed of the thermal spraying powder is likely to become uneven, or the thickness of the thermal spray coating is likely to become uneven. Therefore, to suppress the flowability of the thermal spraying powder from being reduced, the aspect ratio of the granulated and sintered particles is preferably 2.0 or less, more preferably 1.8 or less, and most preferably 1.5 or less. The aspect ratio of the granulated and sintered particles is obtained by dividing the longitudinal diameter, which is the length of the major axis of an ellipsoid that is closest to the shape of the particles, by the lateral diameter, which is the length of the minor axis of the ellipsoid.

Next, a method for manufacturing the thermal spraying powder according to the preferred embodiment will be described. The thermal spraying powder according to the preferred embodiment is manufactured by granulating and sintering a raw powder containing yttrium and aluminum. As the raw powder, an yttrium-aluminum double oxide powder such as yttrium aluminum garnet (abbrev. YAG), yttrium aluminum perovskite (abbrev. YAP), yttrium aluminum monoclinic (abbrev. YAM), or a mixture of an yttria powder and an alumina powder is used. First, slurry is prepared by mixing the raw powder to a dispersion medium. Next, a granulated powder is formed from the slurry using a spray granulator. Thus obtained granulated powder is sintered, then crumbled and classified to manufacture the thermal spraying powder substantially formed of the granulated and sintered particles of the yttrium-aluminum double oxide.

The preferred embodiment has the following advantages.

The total volume of fine pores having a diameter of 6 μm or less in one gram of the granulated and sintered particles is set to 0.06 $cm^3$ or more. Therefore, the thermal spray coating formed of the thermal spraying powder of the preferred embodiment is not likely to delaminate or detach from the base material when subjected to a thermal shock and is suitable for use where the thermal spray coating is exposed to a thermal shock. In addition, the total volume of fine pores having a diameter of 6 μm or less in one gram of the granulated and sintered particles is set to 0.25 $cm^3$ or less. Therefore, the thermal spray coating formed of the thermal spraying powder of the preferred embodiment is not likely to delaminate or detach from the base material in a corrosive atmosphere or an oxidative atmosphere, and is suitable for use in a corrosive atmosphere or an oxidative atmosphere. Also, since the total volume of fine pores having a diameter of 6 μm or less in one gram of the granulated and sintered particles is set to 0.25 $cm^3$ or less, the thermal spray coating is not likely to delaminate or detach from the base material even if a member having reactivity to the base material contacts the thermal spray coating, and is suitable for use in a state where the thermal spray coating contacts a member having reactivity to the base material. Therefore, according to the thermal spraying powder of the preferred embodiment, a thermal spray coating is formed that is suitable for use where the thermal spray coating is subjected to a thermal shock in a corrosive atmosphere or an oxidative atmosphere and for use where the thermal spray coating is subjected to a thermal shock in a state where the thermal spray coating contacts a member having reactivity to a base material.

A thermal spraying powder manufactured by granulating and sintering generally has better flowability as compared to a thermal spraying powder manufactured by fusing and crushing or sintering and crushing. Furthermore, since the manufacturing procedure of the preferred embodiment does not include a crushing process, there is no risk of contamination by impurities during the crushing process. Therefore, the thermal spraying powder of the preferred embodiment that is manufactured by granulating and sintering also has the same advantages.

The preferred embodiment may be modified as follows.

The thermal spraying powder may contain components other than the granulated and sintered particles of the yttrium-aluminum double oxide. However, the content of the granulated and sintered particles of the yttrium-aluminum double oxide in the thermal spraying powder is preferably as close to 100% as possible.

A method for spraying the thermal spraying powder may be other than plasma spraying.

The present invention will now be described in more detail with reference to examples and comparative examples.

In examples 1, 3 to 21, 24, 25 and comparative examples 1, 2, the thermal spraying powders were prepared that were formed of granulated and sintered YAG particles obtained by granulating and sintering the mixture of the yttria powder and the alumina powder. In example 2, the thermal spraying powder was prepared that was formed of the granulated and sintered YAG particles obtained by granulating and sintering the YAG powder. In example 22, the thermal spraying powder was prepared that was formed of the granulated and sintered YAP particles obtained by granulating and sintering the mixture of the yttria powder and the alumina powder. In examples 23, 26, 27, the thermal spraying powders were prepared that were formed of the granulated and sintered YAM particles obtained by granulating and sintering the mixture of the yttria powder and the alumina powder. In comparative example 3, the thermal spraying powder was prepared that was formed of granulated YAG powder obtained by granulating the YAG powder. In comparative example 4, the thermal spraying powder was prepared that was formed of fused and crushed YAG particles obtained by melting and crushing the YAG powder. Specifics of the thermal spraying powders of examples 1 to 27 and comparative examples 1 to 4 are as shown in Table 1.

The column entitled "Total volume of fine pores having a diameter of 6 μm or less" in Table 1 represents the total volume of fine pores having a diameter of 6 μm or less in one gram of particles of the thermal spraying powders measured using a mercury intrusion porosimeter "Poresizer 9320" manufactured by Shimadzu Corporation.

The column entitled "Peak of pore size distribution" in Table 1 represents the peak of the pore size distribution of particles in the thermal spraying powders measured using the mercury intrusion porosimeter "Poresizer 9320" manufactured by Shimadzu Corporation. In general, two peaks are obtained by measuring the pore size distribution of the granulated and sintered particles. Among these two peaks, the peak that appears in the large diameter area (for example, approximately 10 μm) is generated by gaps between the granulated and sintered particles, and the peak generated by the fine pores in the granulated and sintered particles appears only in the small diameter area. In this specification, the peak of the pore size distribution of the granulated and sintered particles refers to the peak generated by the fine pores in the granulated and sintered particles, but not to the peak generated by gaps between the granulated and sintered particles. For reference, a graph of the pore size distribution of the thermal spraying powder according to example 1 measured by the mercury intrusion porosimeter is shown in FIG. 1.

The column entitled "Average particle size of raw powder" in Table 1 represents the average particle size of the raw powder of the thermal spraying powders measured using a laser diffraction/dispersion type of particle size distribution measuring instrument "LA-300" manufactured by HORIBA Ltd.

The column entitled "Crushing strength" in Table 1 represents the crushing strength σ [MPa] of the particles in the thermal spraying powders calculated in accordance with the equation: $\sigma=2.8\times L/\rho/d^2$. In the equation, L represents the critical load [N], d represents the average particle size [mm] of the particles in the thermal spraying powders. The critical load is the compressive load applied to the particles at a point in time when the amount of displacement of an indenter is rapidly increased when the compressive load that increases at a constant rate is applied to the particles by the indenter. The critical load is measured using a micro compression testing instrument "MCTE-500" manufactured by Shimadzu Corporation.

The column entitled "Fisher diameter/average particle size" in Table 1 represents values obtained by dividing the Fisher diameter by the average particle size of the particles in the thermal spraying powders. The Fisher diameter is measured using a Fisher subsieve sizer, and the average particle size is measured using the laser diffraction/dispersion type of particle size distribution measuring instrument "LA-300" manufactured by HORIBA Ltd.

The column entitled "Relative peak intensity of yttria or alumina" in Table 1 represents the maximum value among the ratio of the X-ray diffraction peak of yttria to the X-ray diffraction peak of the yttrium-aluminum double oxide and the ratio of the X-ray diffraction peak of alumina to the X-ray diffraction peak of the yttrium-aluminum double oxide that are obtained when measuring the X-ray diffraction of the thermal spraying powders.

The column entitled "Ratio of yttrium to aluminum" in Table 1 represents the ratio of the number of moles of yttrium in the thermal spraying powders converted into yttria to the number of moles of aluminum in the thermal spraying powders converted into alumina.

The weight of the thermal spray coatings formed by plasma spraying the thermal spraying powders of examples 1 to 27 and comparative examples 1 to 4 under conditions shown in Table 2 was measured. Then, based on the ratio of the weight of the thermal spray coating to the weight of the thermal spraying powder used for spraying, or the deposit efficiency, the thermal spraying powders were evaluated according to a four rank scale: excellent (4), good (3), acceptable (2), and poor (1). More specifically, when the deposit efficiency was 55% or more, the thermal spraying powder was ranked excellent, when it was 50% or more and less than 55%, the thermal spraying powder was ranked good, when it was 45% or more and less than 50%, the thermal spraying powder was ranked acceptable, and when it was less than 45%, the thermal spraying powder was ranked poor. The evaluation results are shown in the column entitled "Deposit efficiency" in Table 1.

The thermal spraying powders of examples 1 to 27 and comparative examples 1 to 4 were plasma sprayed in accordance with the conditions shown in Table 2 to form the thermal spray coatings. Each thermal spray coating was then cut along a plane that is perpendicular to the upper surface of the thermal spray coating. After the cut surface was mirror polished, the porosity of the thermal spray coating at the cut surface was measured using an image analysis processor "NSFJ1-A" manufactured by N Support Corporation. Based on the measured porosity, the thermal spraying powders were evaluated according to a three rank scale: good (3), acceptable (2), and poor (1). More specifically, when the porosity was 5% or more and less than 10%, the thermal spraying powder was ranked good, when it was 3% or more and less than 5%, or 10% or more and less than 13%, the thermal spraying powder was ranked acceptable, and when it was less than 3% or 13% or more, the thermal spraying powder was ranked poor. The evaluation results are shown in the column entitled "Density of coating" in Table 1.

TABLE 1

| | Total volume of fine pores having a diameter of 6 μm or less [$cm^3/g$] | Peak of pore size distribution [μm] | Average particle size of raw powder [μm] | Crushing strength [MPa] | Fisher diameter/ average particle size | Relative peak intensity of yttria or alumina | Ratio of yttrium to aluminum | Deposit efficiency | Density of coating |
|---|---|---|---|---|---|---|---|---|---|
| Ex. 1 | 0.16 | 1.23 | 5.3 | 16 | 0.22 | 0 | 0.60 | 4 | 3 |
| Ex. 2 | 0.14 | 2.14 | 6.1 | 12 | 0.21 | 0 | 0.60 | 4 | 3 |
| Ex. 3 | 0.08 | 1.09 | 3.1 | 24 | 0.25 | 0 | 0.60 | 2 | 2 |
| Ex. 4 | 0.22 | 2.94 | 7.7 | 10 | 0.21 | 0 | 0.60 | 4 | 2 |
| Ex. 5 | 0.11 | 0.43 | 3.3 | 22 | 0.25 | 0 | 0.60 | 3 | 3 |
| Ex. 6 | 0.19 | 3.84 | 9.0 | 10 | 0.23 | 0 | 0.60 | 3 | 3 |
| Ex. 7 | 0.10 | 0.36 | 3.7 | 20 | 0.25 | 0 | 0.60 | 3 | 2 |
| Ex. 8 | 0.18 | 4.12 | 8.4 | 11 | 0.22 | 0 | 0.60 | 4 | 2 |
| Ex. 9 | 0.10 | 0.65 | 2.3 | 24 | 0.24 | 0 | 0.60 | 4 | 3 |
| Ex. 10 | 0.19 | 3.47 | 10.9 | 14 | 0.23 | 0 | 0.60 | 3 | 3 |
| Ex. 11 | 0.11 | 0.58 | 1.7 | 13 | 0.24 | 0 | 0.60 | 4 | 2 |
| Ex. 12 | 0.15 | 3.68 | 12.8 | 10 | 0.23 | 0 | 0.60 | 2 | 3 |
| Ex. 13 | 0.18 | 1.83 | 5.3 | 16 | 0.26 | 0 | 0.60 | 4 | 3 |
| Ex. 14 | 0.20 | 1.83 | 5.3 | 16 | 0.20 | 0 | 0.60 | 3 | 3 |
| Ex. 15 | 0.16 | 1.83 | 5.3 | 16 | 0.27 | 0 | 0.60 | 4 | 2 |
| Ex. 16 | 0.19 | 1.83 | 5.3 | 16 | 0.13 | 0 | 0.60 | 2 | 2 |
| Ex. 17 | 0.20 | 1.68 | 4.8 | 7 | 0.21 | 0 | 0.60 | 4 | 3 |
| Ex. 18 | 0.13 | 0.86 | 4.4 | 28 | 0.24 | 0 | 0.60 | 3 | 3 |
| Ex. 19 | 0.18 | 1.98 | 4.8 | 6 | 0.22 | 0 | 0.60 | 4 | 2 |
| Ex. 20 | 0.15 | 0.76 | 4.4 | 34 | 0.25 | 0 | 0.60 | 3 | 2 |
| Ex. 21 | 0.11 | 0.44 | 1.8 | 13 | 0.23 | 0 | 0.60 | 4 | 2 |
| Ex. 22 | 0.13 | 1.95 | 5.3 | 15 | 0.21 | 0.03 | 1.00 | 4 | 3 |
| Ex. 23 | 0.11 | 2.04 | 5.3 | 14 | 0.22 | 0.08 | 2.00 | 3 | 3 |
| Ex. 24 | 0.12 | 2.13 | 5.3 | 12 | 0.23 | 0.18 | 0.39 | 3 | 3 |
| Ex. 25 | 0.12 | 2.34 | 5.3 | 15 | 0.22 | 0.24 | 0.27 | 2 | 3 |
| Ex. 26 | 0.13 | 2.85 | 5.3 | 14 | 0.23 | 0.17 | 2.35 | 3 | 3 |
| Ex. 27 | 0.10 | 2.65 | 5.3 | 13 | 0.24 | 0.26 | 2.56 | 2 | 2 |
| C. Ex. 1 | 0.05 | 0.84 | 2.9 | 30 | 0.27 | 0 | 0.60 | 1 | 1 |

TABLE 1-continued

| | Total volume of fine pores having a diameter of 6 μm or less [$cm^3/g$] | Peak of pore size distribution [μm] | Average particle size of raw powder [μm] | Crushing strength [MPa] | Fisher diameter/ average particle size | Relative peak intensity of yttria or alumina | Ratio of yttrium to aluminum | Deposit efficiency | Density of coating |
|---|---|---|---|---|---|---|---|---|---|
| C. Ex. 2 | 0.27 | 3.14 | 9.2 | 9 | 0.22 | 0 | 0.60 | 4 | 1 |
| C. Ex. 3 | 0.25 | 2.45 | 5.3 | 2 | 0.12 | 0 | 0.60 | — | — |
| C. Ex. 4 | — | — | — | — | 0.36 | 0 | 0.60 | 1 | 2 |

TABLE 2

| |
|---|
| Base material: aluminum plate (250 mm × 75 mm × 3 mm) that has been blast finished using a brown alumina abrasive (A#40) |
| Spray gun: "SG-100" manufactured by Praxair |
| Thermal spraying powder feeder: "Model 1264" manufactured by Praxair |
| Ar gas pressure: 50 psi |
| He gas pressure: 50 psi |
| Voltage: 37.0 V |
| Current: 900 A |
| Spraying distance: 120 mm |
| Feed rate of thermal spraying powders: 20 g/minute |

As shown in Table 1, in examples 1 to 27, any of the evaluations for the density of the thermal spray coating is either acceptable or good. In addition, in examples 1 to 27, any of the evaluations for the deposit efficiency is also acceptable, good, or excellent. Contrastingly, in comparative examples 1 and 2, the evaluations for the density of the thermal spray coating are poor. In comparative example 3, clogging occurred in a powder tube, which feeds the thermal spraying powder from the thermal spraying powder feeder to the spray gun. Thus, the thermal spray coating was not formed. In comparative example 4, the evaluation for the density of the thermal spray coating is acceptable, but the evaluation for the deposit efficiency is poor.

The invention claimed is:

1. A thermal spraying powder, comprising granulated and sintered particles of an yttrium-aluminum double oxide obtained by granulating and sintering a raw powder containing yttrium and aluminum, wherein the total volume of fine pores having a diameter of 6 μm or less in one grain of the granulated and sintered particles is 0.06 to 0.25 $cm^3$.

2. The thermal spraying powder according to claim 1, wherein the peak of a pore size distribution of the granulated and sintered particles is 0.40 to 4.0 μm.

3. The thermal spraying powder according to claim 1, wherein the average particle size of the raw powder before being granulated and sintered is 2 to 12 μm.

4. The thermal spraying powder according to claim 1, wherein the crushing strength of the granulated and sintered particles is 7 to 30 MPa.

5. The thermal spraying powder according to claim 1, wherein the ratio of the Fisher diameter of the granulated and sintered particles to the average particle size of the granulated and sintered particles is 0.27 or less.

6. The thermal spraying powder according to claim 1, wherein the intensity of the maximum peak among an X-ray diffraction peak of a (420) plane of a garnet phase of the yttrium-aluminum double oxide, an X-ray diffraction peak of a (420) plane of a perovskite phase of the yttrium-aluminum double oxide, and an X-ray diffraction peak of a (−122) plane of a monoclinic phase of the yttrium-aluminum double oxide is defined as a first peak intensity, and the intensity of the maximum peak among an X-ray diffraction peak of a (222) plane of yttria and an X-ray diffract can peak of a (104) plane of alumina is defined as a second peak intensity, and the ratio of the second peak intensity of the granulated and sintered particles to the first peak intensity of the granulated and sintered particles is 0.20 or less.

7. The thermal spraying powder according to claim 1, wherein the bulk specific gravity of the granulated and sintered particles is 1.6 or less.

8. The thermal spraying powder according to claim 1, wherein the average particle size of the granulaled and sintered particles is 15 to 70 μm.

9. The thermal spraying powder according to claim 1, wherein the ratio of the number of moles of yttrium in the granulated and sintered particles converted into yttria to the number of moles of aluminum in the granulated and sintared particles converted into alumina is 0.30 to 1.5.

10. The thermal spraying powder according to claim 1, wherein the angle of repose of the granulated and sintered particles is 50 degrees or less.

11. The thermal spraying powder according to claim 1, wherein the aspect ratio of the granulated and sintered particles is 2.0 or less.

* * * * *